US010690297B2

(12) United States Patent
Gommans et al.

(10) Patent No.: US 10,690,297 B2
(45) Date of Patent: Jun. 23, 2020

(54) TUBULAR LIGHT EMITTING DEVICE

(71) Applicant: SIGNIFY HOLDING B.V., Eindhoven (NL)

(72) Inventors: Hendrikus Hubertus Petrus Gommans, Eindhoven (NL); Jochen Renaat Gheluwe, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 75 days.

(21) Appl. No.: 15/574,658

(22) PCT Filed: May 4, 2016

(86) PCT No.: PCT/EP2016/060087

§ 371 (c)(1),
(2) Date: Nov. 16, 2017

(87) PCT Pub. No.: WO2016/184691

PCT Pub. Date: Nov. 24, 2016

(65) Prior Publication Data

US 2018/0135812 A1 May 17, 2018

(30) Foreign Application Priority Data

May 18, 2015 (EP) ..... 15167942

(51) Int. Cl.
*F21K 9/275* (2016.01)
*F21K 9/69* (2016.01)
(Continued)

(52) U.S. Cl.
CPC ..... *F21K 9/275* (2016.08); *F21K 9/27* (2016.08); *F21K 9/60* (2016.08); *F21K 9/68* (2016.08);
(Continued)

(58) Field of Classification Search
CPC . F21V 5/005; F21V 5/045; F21K 9/27; F21K 9/275; F21K 9/60; F21K 9/68;
(Continued)

(56) References Cited

U.S. PATENT DOCUMENTS 7,229,192 B2 * 6/2007 Mayfield, III ..... F21S 8/04 362/223
7,559,672 B1 * 7/2009 Parkyn ..... A47B 97/00 362/127
(Continued)

FOREIGN PATENT DOCUMENTS

CN 1918498 A 2/2007
CN 102695915 A 9/2012
(Continued)

*Primary Examiner* — Thien M Le
*Assistant Examiner* — April A Taylor
(74) *Attorney, Agent, or Firm* — Akarsh P. Belagodu

(57) ABSTRACT

A tubular light comprises an elongate light source (10) and a tubular housing (18) around the light source. An optical beam shaping arrangement (20) is provided within the housing. It has an effective focal distance, in the plane perpendicular to the length axis, which varies in dependence on the angular position around the optical beam shaping arrangement. The effective focal distance is longer for light in a light output optical axis direction than for light output laterally to the sides of the light output optical axis. This means the beam shaping, e.g. collimation, is greater at the edges of the light output beam than in the middle, so there is light mixing within the output beam.

13 Claims, 6 Drawing Sheets

(51) Int. Cl.

| | |
|---|---|
| ***F21V 5/00*** | (2018.01) |
| ***F21K 9/27*** | (2016.01) |
| ***F21K 9/60*** | (2016.01) |
| ***F21V 5/04*** | (2006.01) |
| ***F21K 9/68*** | (2016.01) |
| *F21Y 115/10* | (2016.01) |
| *F21Y 107/90* | (2016.01) |
| *F21Y 107/20* | (2016.01) |
| *F21Y 103/10* | (2016.01) |

(52) U.S. Cl.
CPC ..... *F21K 9/69* (2016.08); *F21V 5/005* (2013.01); *F21V 5/045* (2013.01); *F21Y 2103/10* (2016.08); *F21Y 2107/20* (2016.08); *F21Y 2107/90* (2016.08); *F21Y 2115/10* (2016.08)

(58) Field of Classification Search
CPC .... F21K 9/69; F21Y 2103/10; F21Y 2107/20; F21Y 2107/90; F21Y 2115/10
See application file for complete search history.

(56) References Cited

U.S. PATENT DOCUMENTS

| | | | | |
|---|---|---|---|---|
| 8,382,314 | B2 | 2/2013 | Ou et al. | |
| 8,403,522 | B2 | 3/2013 | Chang | |
| 8,556,454 | B2 | 10/2013 | Pei et al. | |
| 8,721,113 | B2 | 5/2014 | Lai et al. | |
| 8,998,448 | B2 * | 4/2015 | Chang | F21V 5/00 362/246 |
| 2006/0044806 | A1 * | 3/2006 | Abramov | F21V 5/007 362/337 |
| 2007/0263388 | A1 * | 11/2007 | Lai | F21S 8/086 362/287 |
| 2010/0067230 | A1 | 3/2010 | Uang et al. | |
| 2010/0110678 | A1 | 5/2010 | Shen et al. | |
| 2011/0194295 | A1 * | 8/2011 | Householder | F21V 5/04 362/347 |
| 2011/0260182 | A1 * | 10/2011 | Hussell | H01L 25/0753 257/91 |
| 2011/0280010 | A1 | 11/2011 | Ou et al. | |
| 2013/0051029 | A1 * | 2/2013 | Suzuki | F21V 5/045 362/297 |
| 2014/0160740 | A1 | 6/2014 | Hwang et al. | |
| 2014/0160743 | A1 | 6/2014 | Ye et al. | |
| 2015/0029717 | A1 * | 1/2015 | Shen | F21V 5/005 362/235 |
| 2015/0062916 | A1 * | 3/2015 | Takayama | F21V 13/04 362/308 |

FOREIGN PATENT DOCUMENTS

| | | | |
|---|---|---|---|
| CN | 103090286 | A | 5/2013 |
| CN | 104169645 | A | 11/2014 |
| DE | 102012103707 | A1 | 10/2013 |
| DE | 102013017141 | A1 | 10/2014 |
| JP | 2011060719 | A | 3/2011 |
| JP | 3172924 | U | 12/2011 |
| JP | 2013214422 | A | 10/2013 |
| JP | 2013232411 | A | 11/2013 |
| KR | 20120104599 | A | 9/2012 |
| KR | 101510755 | B1 | 4/2015 |
| WO | WO2009133615 | A1 | 11/2009 |
| WO | 2011021457 | A1 | 2/2011 |
| WO | WO2013153212 | A2 | 10/2013 |

* cited by examiner

TUBULAR LIGHT EMITTING DEVICE

CROSS-REFERENCE TO PRIOR APPLICATIONS

This application is the U.S. National Phase application under 35 U.S.C. § 371 of International Application No. PCT/EP2016/060087, filed on May 4, 2016, which claims the benefit of European Patent Application No. 15167942.0, filed on May 18, 2015. These applications are hereby incorporated by reference herein.

FIELD OF THE INVENTION

This invention relates to tubular light emitting devices.

BACKGROUND OF THE INVENTION

Standard i.e. halogen tubular lighting ("TL") tubes, as well as typical LED retrofit solutions, provide light in all directions. To create a beam-shape, they are placed in a fixture which comprises a reflector and/or other optical elements to redirect the light from the tube into a desired beam shape.

LED technology allows for the integration of the light generation elements (the LEDs) and the beam shaping optics into the tubular lighting housing, thereby eliminating the need for expensive external housings and optics. Current tubular LED (known as "TLED") solutions are known which integrate optics into the tubular housing to optimize efficiency and to create a desired beam shape. For example, lenses or total internal reflection collimators may be mounted over on the LEDs in the tubular housing.

Although this does allow for the creation of a beam shape, this also lead to a very spotty appearance of the tube (due to the close proximity of the optics and the LEDs), which in some situations is disliked for aesthetic reasons, and may even be uncomfortable due to the high peak brightness.

Another disadvantage of typical lenses used for beam shaping is that for white light lighting devices they generally cause color differences as a function of angle of the exiting light. This is caused by color non-uniformities of the exit window of a typical white LED, which are typically based on the use of blue emitting LED die covered by a phosphor which partially converts this blue light into larger wavelengths (e.g. yellow), to form white light (based on the combination of the original blue light and the phosphor-converted yellow light). Typically, this means a more bluish light from the center of the LED, while more yellowish light is emitted from the edges of the LED.

Typically, when beam shaping this light with lenses or collimators, these spatial color differences are converted to angular color differences causing the center of the beam to be bluish and the edges yellowish (or vice versa, depending on the type of optics used). In certain applications this is highly disliked, especially in applications where the light is used to illuminate white objects.

SUMMARY OF THE INVENTION

The invention is defined by the claims.

According to examples in accordance with an aspect of the invention, there is provided a tubular light, comprising:

an elongate light source having a length axis and a light output optical axis perpendicular to the length axis;

a tubular housing around the light source;

an optical beam shaping arrangement within the housing around an inner surface of at least an angular portion of the tubular housing for beam shaping of the light output from the elongate light source in a plane perpendicular to the length axis, wherein the optical beam shaping arrangement has an effective focal distance, in the plane perpendicular to the length axis, which varies in dependence on the angular position around the optical beam shaping arrangement, such that the effective focal distance is longer for light in the light output optical axis direction than for light output laterally to the sides of the light output optical axis.

The invention thus provides a tubular light emitting device which is able to provide beam shaping but with reduced angular color differences. By providing a longer focal distance for light along the optical axis, the level of collimation is reduced compared to the more angled light. Thus, there is light mixing for the light nearer the optical axis and this reduces color artifacts.

The effective focal distance may be defined as the distance along the optical axis from the surface of the beam shaping component to the point at which normally directed light is focused. The beam shaping arrangement for example has a part-cylindrical shape matching the shape of the tubular housing. The focal point is at the location of the light source or else set back from the light source (i.e. further from the beam shaping arrangement than the light source).

The elongate light source preferably comprises at least one row of LEDs.

Each LED may comprise an optical beam shaping element directly over the LED. This can contribute to color variations in dependence on the angular output direction, and the beam shaping optical arrangement reduces these color variations.

The LEDs are for example provided over a carrier, and the light output optical axis is perpendicular to the plane of the carrier. The light source may thus comprise standard upward emitting LEDs on a printed circuit board or other carrier.

The effective focal position of the optical beam shaping may coincide with the position of the elongate light source for the portions of the beam shaping arrangement most laterally offset from the light output optical axis. This means that there is most collimation for the light most angularly offset from the optical axis. If the light source is at the effective focal position, then the light from the light source is redirected to a beam parallel to the optical axis.

The optical beam shaping arrangement may comprise an array of elongate light redirecting facets extending in the length axis direction, wherein facets at different angular positions around the optical beam shaping arrangement have different facet angle with respect to the incident light from the light source. The different facets thus implement different levels of beam redirection, in particular with a greater amount of beam redirection at laterally outer areas than near the optical axis. Thus variable focal distances in dependence on the angular positions of the facets with respect to the light output optical axis are adjustable.

Some of or all of the facets may comprise refracting surfaces.

There is a maximum amount of angular beam redirection that can be achieved by light passing through a refractive element. Thus, some or all of the facets may comprise total internal reflection surfaces. These enable greater amounts of light redirection.

A pair of facets together define a prismatic ridge. The pitch of these ridges may vary, but it may for example be in the range 20 μm to 500 μm. The ridge height (or trough depth) may for example be in the range 30 μm to 100 μm.

The beam shaping optical arrangement for example provides a collimation function, with a lesser degree of collimation for light in the light output optical axis direction than for light output laterally to the sides of the light output optical axis.

The beam shaping optical arrangement may provide a beam with a narrower beam width than the beam width of the elongate light source. This may be a downward beam in use of the light, for example an office beam profile or a narrow, spot, beam profile.

The beam shaping optical arrangement may provide a beam in the general direction of the light output optical axis with a narrower beam width than the beam width of the elongate light source, combined with a beam in the opposite general direction. This may be used to provide a downward beam for office lighting in combination with an upward indirect beam for ceiling lighting.

There may be two elongate light sources each having a length axis and a light output optical axis, wherein the the beam shaping optical arrangement provides a bat wing beam profile.

The beam shaping arrangement, for example foil, may be rigid or flexible. In some embodiments the beam shaping arrangement corresponds to a transparent, flexible or resiliently rigid material. Suitable materials are, for example, polymethylmetacrylate (PMMA), polyethylene, polypropylene, polystyrene, polyvinyl chloride, polytetrafluoroethylene (PTFE), etc. The arcuate length of the beam shaping arrangement, in the plane perpendicular to the length axis, is preferably greater than the diameter of the tubular housing times $\pi/2$. This particular example means that the beam shaping arrangement can be pressed against the inner surface of the tubular housing and maintain its curvature, i.e. it unfolds itself against the inner curvature of the tubular housing. The beam shaping elements do not need to cover the entire width of the structure, so that part of the arcuate length of the beam shaping arrangement may have no beam shaping elements—these may be concentrated in a central region of the beam shaping arrangement.

The light is preferably a tubular LED lamp designed for use without an external optical beam shaping housing or luminaire.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a tubular light, comprising an elongate light source and a tubular housing around the light source. An optical beam shaping arrangement is provided within the housing. It has an effective focal distance, in the plane perpendicular to the length axis, which varies in dependence on the angular position around the optical beam shaping arrangement. The effective focal distance is longer for light in a light output optical axis direction than for light output laterally to the sides of the light output optical axis. This means the beam shaping, e.g. collimation, is greater at the edges of the light output beam than in the middle, so there is light mixing within the output beam.

The output beam shape may be a collimated light beam with a certain beam width, or a bat wing profile, for example. The light mixing gives reduced color over angle differences. The beam shaping arrangement for example comprises a single optical foil with linear micro-facets.

Figure 1:
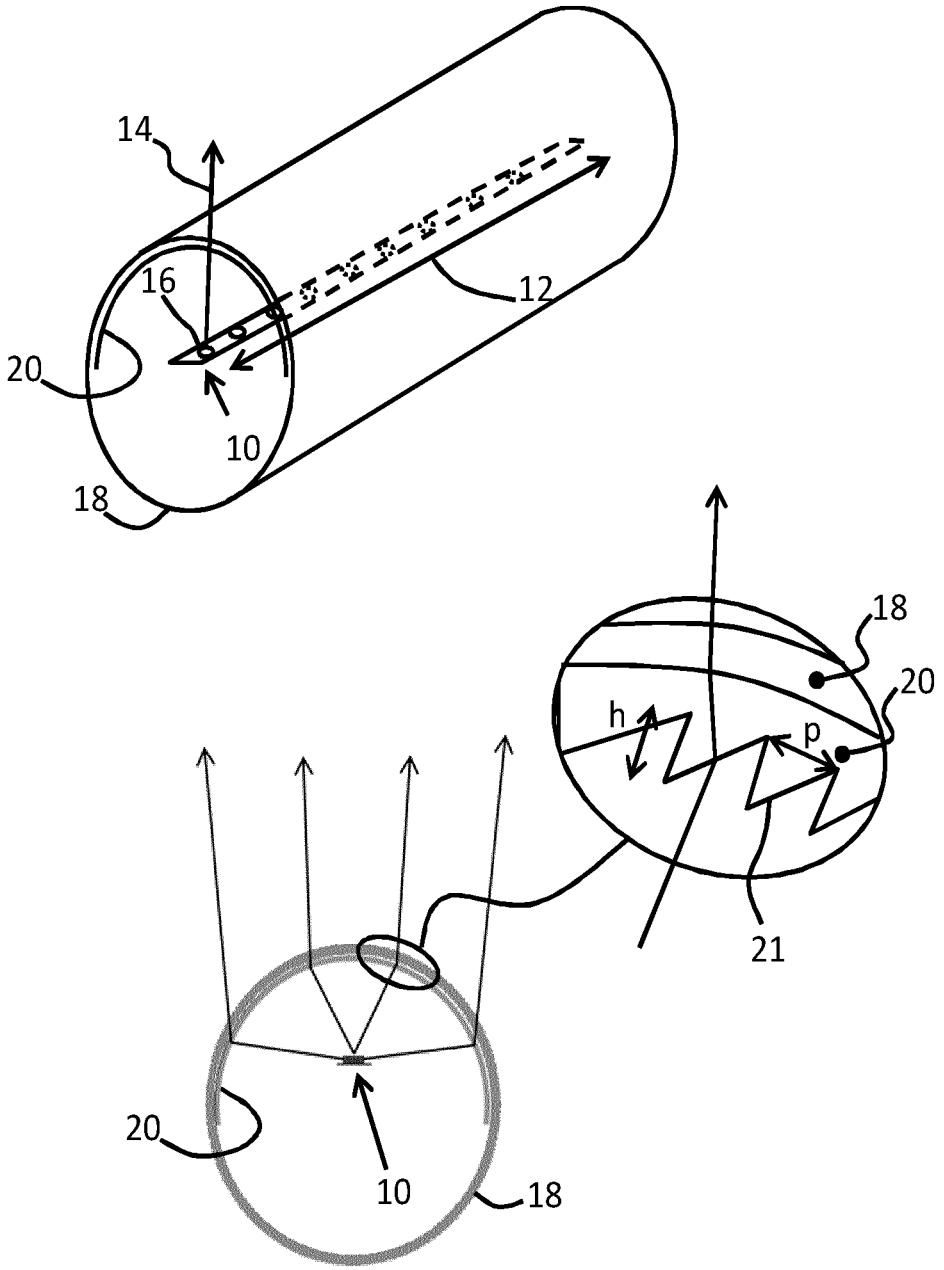
FIG. 1 shows a tubular light in perspective view and in cross section.

FIG. 1 shows a tubular light in perspective view and in cross section. The light comprises an elongate light source 10 having a length axis 12 and a light output optical axis 14 perpendicular to the length axis. The light source 10 comprises a carrier, for example a printed circuit board, on which discrete lighting units, in particular LEDs 16, are mounted.

A tubular housing 18 is around the light source with a circular or elliptical cross sectional shape. An optical beam shaping arrangement 20 is within the housing 18 around an inner surface of the tubular housing, for beam shaping of the light output from the elongate light source in a plane perpendicular to the length axis. The beam shaping arrangement may be all around the inner surface, or it may only extend around only an angular portion of the inner surface to which light is directed by the LEDs.

The purpose of the beam shaping arrangement is principally to convert the Lambertian wide angle (e.g. 150 degree) output from the LEDs into a more collimated beam. However, an additional color mixing function is also provided, which aims to mix the light output from different parts of the LED output surface so that differences in color as a function of the light output direction are averaged out. To achieve this, the optical beam shaping arrangement 20 has an effective focal distance, in the plane perpendicular to the length axis (i.e. in the plane shown in the lower part of FIG. 1), which varies in dependence on the angular position. This focal distance gives a focal point at the position of the light source 10 or else behind it (i.e. on the opposite side of the light source to the beam shaping arrangement). For a focal point at the light source, the light from the light source becomes collimated to a normal direction, whereas for a focal point behind the light source, the light from the light source remains divergent after processing by the optical beam shaping arrangement 20. The level of collimation is reduced for light near the optical axis compared to more angled light.

The tubular housing 18 may be a transparent glass or plastic tube, for example with the form factor of typical tubular lighting tubes. The typical diameters of such tubes are 38 mm, 26 mm and 16 mm. The line of LEDs does not necessarily need to be in the exact center of the tube, and the LEDs emit light in an approximately Lambertian distribution.

The beam shaping optics comprises a micro-facetted transparent foil placed on the inside of the tubular housing, following the inner curvature of the tubular housing. The transparent foil may be designed to have some resilient rigidity causing it to have a tendency to flatten out if it is bent. In this way, the foil will automatically press itself against the inner wall of the housing as long as its width (i.e. its arcuate length in the cross section of FIG. 1) is larger than the inner diameter of the tubular housing times $\pi/2$. In other words, the foil fits against more than half of the inner circumference and thus folds back on itself so cannot move translationally. The arcuate length can be any size up to the full circumference (the inner diameter of the tubular housing times $\pi$). A smaller foil arcuate length (smaller than the inner diameter of the tubular housing times $\pi/2$, which therefore does not press itself against the inner wall) may be desired if the foil only deflects a part of the light, or if the LEDs are positioned very near the exit surface (as in FIG. 10).

Note that the beam shaping facets may not be needed over the full extent of the beam shaping arrangement, particularly if it is a longer curve than is needed optically in order to provide the mechanical fixation as described above.

The foil does not need to be in contact with the outer tubular housing from an optical point of view. It could for example be positioned between the LEDs and the tubular housing. The advantage of the foil against the inner surface of the tubular housing is for a self-supporting function rather than for an optical function. The foil does not need to be against the inner surface of the tubular housing if it is supported differently.

When the foil is against the inner surface, it may be laminated to the inside of the tubular housing or mechanical clips such as internal rings can be used to hold the foil in place by pressing it at regular intervals against the wall of the housing. In these examples, the mechanical strength of the total device is mainly provided by the glass (or plastic) transparent outer tubular housing.

The cross section in FIG. 1 schematically shows a few of the facets 21 used to refract and thereby redirect the incident light.

The foil has a constant cross sectional shape along its length, so it may be formed as an extruded component or it may be machined in a linear manner. The facets then comprise elongate light redirecting facets extending in the length axis direction, wherein facets at different angular positions around the optical beam shaping arrangement have different facet angle with respect to the incident light from the light source. The different facets thus implement different levels of beam redirection, in particular with a greater amount of beam redirection at laterally outer areas than near the optical axis.

To define a continuous beam shaping surface, one facet may be in a radial direction i.e. parallel to the incoming light, and it functions as the junction between adjacent active facets. One of these inactive facets combined with an active facet together form a ridge (or trough). The pitch of these ridges in the plane perpendicular to the length axis (shown as p in FIG. 1) may vary around the beam shaping arrangement, but it may for example be in the range 20 μm to 500 μm. The ridge height (or trough depth, shown as h in FIG. 1) may for example be in the range 30 μm to 100 μm. It may be a constant value across the beam shaping arrangement.

Beam shaping optical foils using light redirecting facets are known. Generally, they may be used to provide light collimation, for example in the manner of a Fresnel plate, which provides steeper facet angles further from the light source, to give a greater amount of light redirection towards the desired normal direction.

Figure 2:
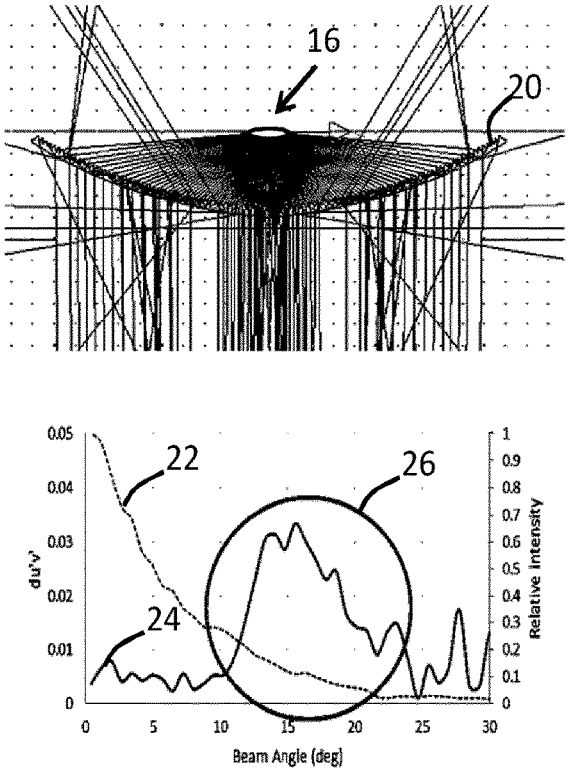
FIG. 2 shows how a beam shaping arrangement may be designed to provide a collimated beam and shows the intensity as a function of beam angle, and the color variation as a function of beam angle.

FIG. 2 shows, in the top image, how the beam shaping arrangement 20 may be designed to provide a collimated beam, by showing ray paths from the light source 16. There are various stray light paths shown which result from reflections at boundaries between facets—these do not form part of the intended beam shaping function but they are unavoidable in a real design.

The bottom part of FIG. 2 shows as plot 22 the intensity as a function of beam angle, and it shows the color variation as a function of beam angle as plot 24. The color variation is defined by the parameter du'v' which represents the distance between two color points in the CIE1976 chromaticity diagram. The color difference to a general average color output for the full output spectrum is determined.

Plot 22 shows a rapid cut off of light intensity with respect to angle, indicating good collimation. However, region 26 of the plot shows significant color difference at a certain range of output angles.

This level of collimation is typically not required for most applications.

This invention provides a different trade-off between the degree of collimation and the color uniformity. The use of a facetted foil means that there is the possibility to independently control the amount of redirection of light caused by each facet (in a standard lens this is not possible due to the requirement of having a continuous surface). Thus, the facets may be designed in such a way that the light coming from different angles and regions from the LED package (and having different colors) is mixed over the entire beam, so the resulting light distribution shows reduced angular color differences so that they are no longer visible or disturbing in the application.

Figure 3:
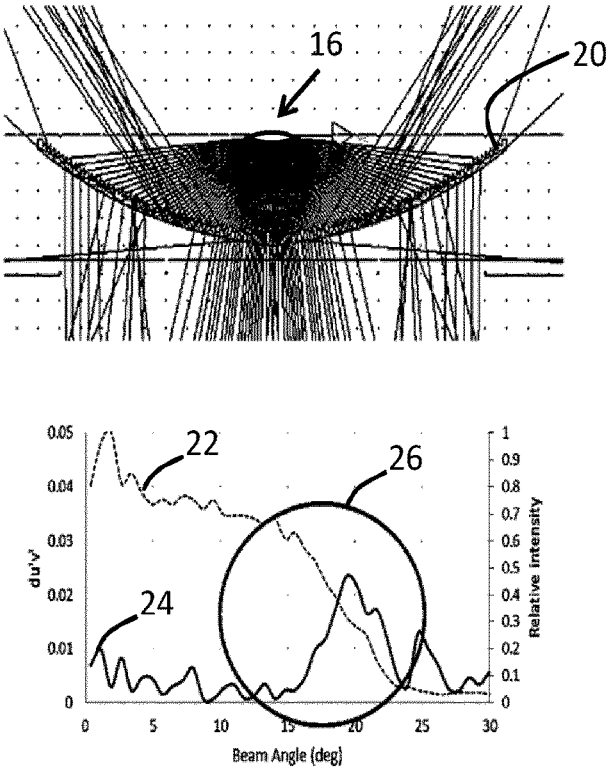
FIG. 3 shows how the beam shaping arrangement may be designed to provide a reduction in collimation but improved color mixing, and shows the intensity as a function of beam angle, and the color variation as a function of beam angle.

FIG. 3 shows this approach.

The top image shows the ray paths with a reduced level of collimation near the optical axis but a similar performance at the edges compared to the design of FIG. 2.

The output beam remains relatively narrow, with 36 degrees full width at half maximum (FWHM) (i.e. 2×18 degrees, where 18 degrees gives a relative intensity of 0.5). This compares to a FWHM in FIG. 2 of around 10 degrees. The field angle (the angle within which the relative intensity is at least 0.1) is 45 degrees (i.e. 2×22.5 degrees at which the intensity drops to 0.1), which is sufficiently narrow for most applications using linear lighting. This compares to a field angle in FIG. 2 of around 30 degrees.

The benefit of relaxing these collimation requirements is a reduction in color variation as shown in plot 24 and in region 26.

There is thus a relaxation of the collimation requirements, for example so that the FWHM is greater than 20 degrees, for example greater than 30 degrees, and the field angle is greater than 20 degrees, for example greater than 30 degrees.

This then enables the color uniformity to be increased, for example so that the maximum is value below 0.03.

The requirements on the value du'v' will depend on the application.

Even better color uniformity may be desired and achieved, for example the maximum value of du'v' may be below 0.005 everywhere, although with current LED packages this is practically never reached in collimated applications. From a practical point of view the value of du'v' may be allowed to reach 0.01 or higher at the tails of a beam spot application, where for instance the intensity is only 0.1 times its peak value.

Currently, the color difference in the beam output from tubular LED lighting solutions has a major impact in the markets: it has become a significant cause of dissatisfaction for TLED solutions. The approach above pushes the worst color differences to the lower intensity regions (i.e. the shift to the right of the peak 26 from FIG. 2 to FIG. 3) as well as reducing the color differences, thereby making a significant improvement.

Note that FIGS. 2 and 3 are the results of an optical simulation, and accordingly show some noise as small oscillations.

The way the beam shaping optical arrangement is designed to achieve the optical function shown in FIG. 3 will now be explained with reference to FIG. 4.

The color difference in known fully collimated beams is due to the imaging behavior of such systems. In such systems, the light source is placed at the lens focal plane, so that the light source is imaged to infinity.

By changing the focusing arrangement, the image is blurred (i.e. the image contrast is reduced) as much as possible, while minimizing its impact on the beam shape. This is achieved by sweeping the light deflecting angles so that they still remain within the preferred overall beam shape direction.

By considering the optical foil overall as analogous to a lens component, a lens is created with a varying focal plane as a function of lateral (i.e. angular) distance from the optical axis. The focal plane is located behind the source position (i.e. on the opposite side of the source position to the beam shaping arrangement), so as to prevent imaging.

Only for facets located at the maximum lateral distance from the optical axis is the focal plane optionally chosen to correspond with the light source position.

Figure 4:
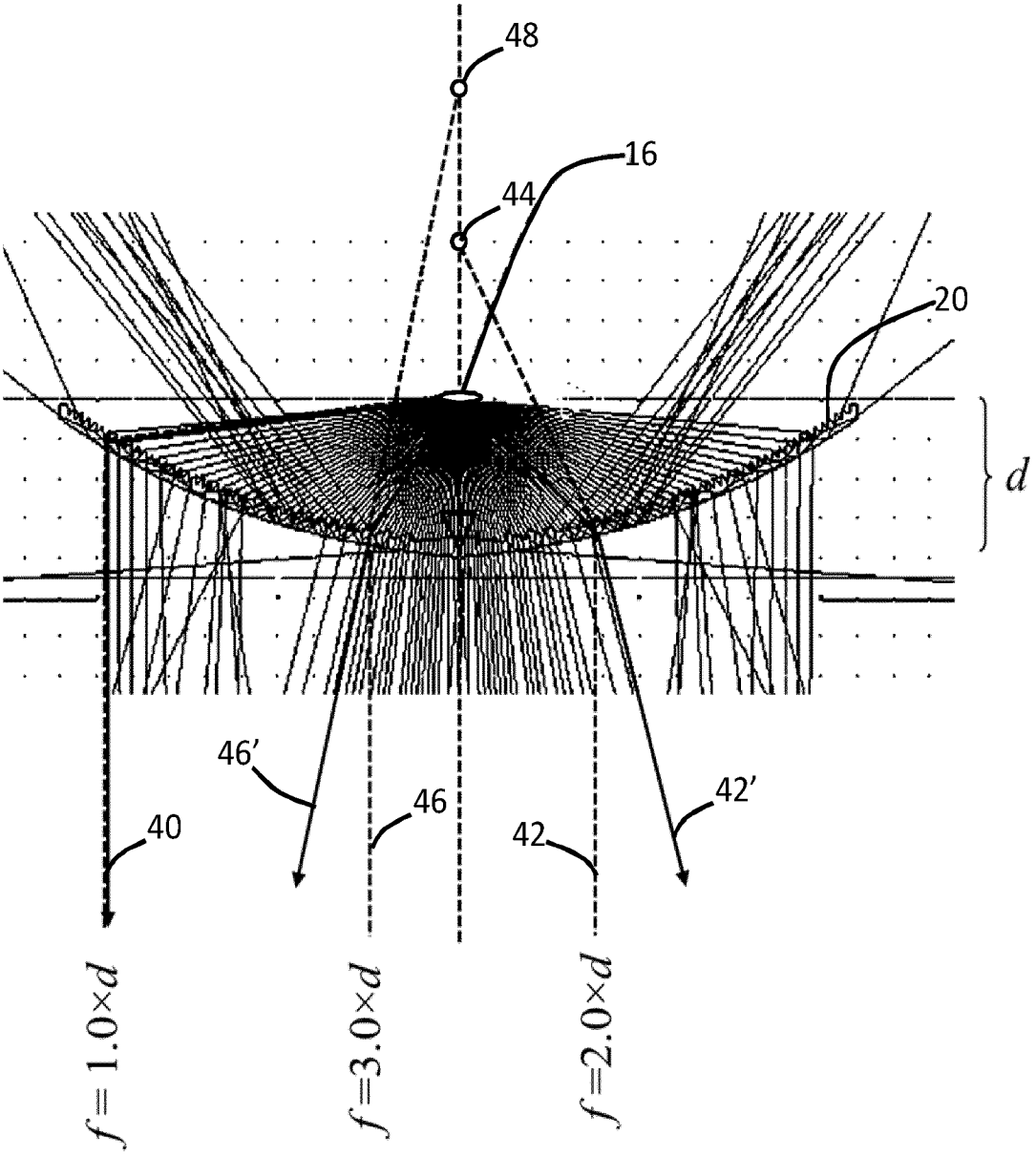
FIG. 4 shows the way in the beam shaping optical arrangement is designed to achieve the optical function shown in FIG. 3.

FIG. 4 shows a distance d from the front of the beam shaping arrangement 20 to the location of the light source 16. The focal plane of the beam shaping arrangement is different at different locations. The minimum focal distance is d, and this is the case at the very edges of the beam shaping arrangement, as shown by ray 40. This ray focuses to the light source. At about one third of the distance between the optical axis and the edge of the beam shaping arrangement 20, the focal distance is 2d as shown by ray 42. This ray focuses to a focal point 44 behind the light source. At about one quarter of the distance between the optical axis and the edge of the beam shaping arrangement, the focal distance is 3d as shown by ray 46. This ray focuses to a focal point 48 even further behind the light source.

Rays 42' and 46' show the path of light from the light source through those parts of the beam shaping arrangement. Because the beam shaping arrangement is defocused, the light paths are not redirected to the optical axis direction, but remain divergent, but within the desired overall beam angle.

This design ensures that the light emerging from the central area of the LED and the light emitted from the outer area of the LED are both distributed over the entire beam. This typically means light originating from the center is on average nominally directed away from the beam center, while light originating from the edges of the LED package is nominally directed towards the beam center.

The width of the foil is preferably larger than the diameter of the tubular housing, but the foil does not need to be entirely covered with microstructures. These can be limited to discrete regions of the foil.

The outgoing beams are thus not all deflected parallel to the optical axis but they are swept within a beam angle with respect to the optical axis. The focal point is chosen to correspond to the source position for the facets located at the edge of the lens. However, the source image created by these facets has reduced significantly in size, as a result of the small solid angle subtended at these facets. For these facets the beam sweeping angle can thus be reduced significantly compared to the sweeping angle for the inner facets without yielding imaging contrast.

The desired beam shaping essentially comprises a collimation function. The maximum possible degree of collimation is determined by the ratio of (i) the distance between the beam shaping element 20 and the light source, to (ii) the size of the light emitting area. Hence, the possible degree of collimation is improved by increasing the distance or reducing the light source area if possible. In typical collimating optics, this would imply an increase in module size as the LED size is a given. In this application, the maximum distance is fixed by the tubular housing diameter. Hence, in order to provide the maximum degree of collimation the optical element is preferably as close as possible to the inner side of the tubular housing and therefore has the maximum distance to the LED source. Thus, the beam shaping arrangement conforms to the cylindrical shape of the tubular housing.

Figure 8:
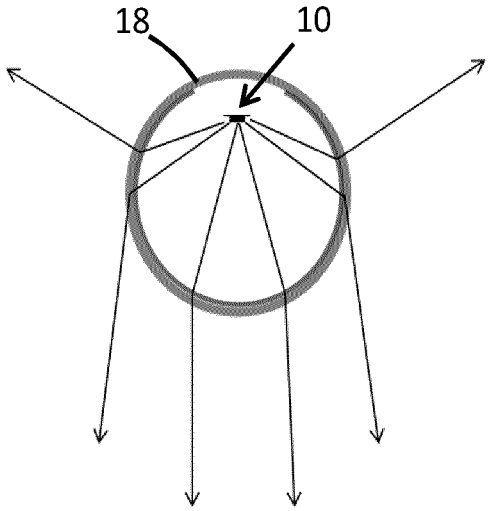
FIG. 8 shows how the profile of FIG. 7(*a*) can be generated using only a single line of LEDs and a single micro-faceted foil.

Furthermore, in order to increase the distance between the optical foil and LEDs to a maximum, the LEDs may be positioned away from the center of the tubular housing, and near the outer rim opposite to the foil (see FIG. 8 for example). Thus, the elongate light source may be located on the optical axis between the center of the tubular housing and the outer rim of the tubular housing opposite the center of the beam shaping arrangement.

The example of FIG. 4 shows the facets on the inside surface of the beam shaping arrangement, and shows a smooth outer surface. However, there may be facets on both sides. The facets become steeper further from the optical axis, in the same way as a Fresnel plate. They also optionally become closer together outwardly from the optical axis, i.e. they are smaller in length in the cross sectional plane. This is because the facets are steeper, so that for a given thickness of the optical foil they need to be closer together.

The facets may have a size (i.e. their length in the cross section perpendicular to the length direction) of 30 μm to 100 μm.

Each LED may comprise an optical beam shaping element, such as a refractive lens or total internal reflecting element, directly over the LED. This provides a beam pre-shaping function. This can also contribute to color variations in dependence on the angular output direction, and the beam shaping optical arrangement reduces these color variations.

By designing the optical beam shaping arrangement 20 with a constant cross sectional shape, so that it is translation invariant in the length direction of the tubular housing, there is no need for alignment with the LEDs in the length direction. The curved shape of the foil around the LEDs is ideal for efficiently capturing and redirecting the light from the LEDs. The optical beam shaping arrangement may be easily inserted or mounted in a standard glass/plastic tubular housing. At the same time, during production the foil can be flat so that no pre-shaping of the foil into a half tube is required.

The foil does not require special mounting techniques and does not require significant mechanical strength: the mechanical strength of the glass or plastic tubular housing is re-used, while the curved shape of the foil against the inner tubular housing surface ensures good structural stability.

The extended nature of the foil as compared to typical lenses or total internal reflection collimators, together with the microstructure design, reduces the peak brightness of the LEDs when looking into the lighting device, by using a larger area of optics to direct the light and therefore increasing the apparent area emitting light. Thus, the high brightness LED spot is averaged out into a line perpendicular to the tubular housing length axis.

To create tubular lights with different beam shapes, a different foil may be used with all other production steps and components remaining the same.

Figure 5:
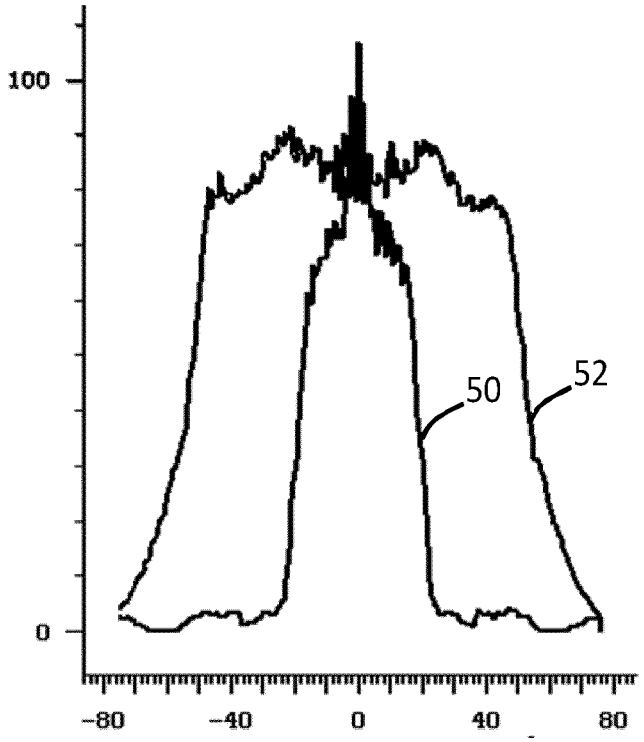
FIG. 5 shows the shape of the beam profile for the arrangement of FIG. 3.

FIG. 5 shows the shape of the beam profile for the arrangement of FIG. 3. Plot 50 is the beam shape in the plane perpendicular to the length axis, and plot 52 is the beam shape in the plane including the length axis and the optical axis (i.e. the vertical plane including the central length axis of the tubular housing). In the beam shaping direction as shown in plot 50, the beam width of 36 degrees and the field angle of 45 degrees mentioned above can be seen.

The type of facets or microstructures that are used depends on the degree by which the direction of an incident ray needs to be changed. This is in turn determined by the desired beam shape. The most convenient and efficient design makes use of extruded refracting facets. Using refraction, rays can be efficiently deflected up to about 45 degrees.

If beam deflection is desired over angles larger than 45 degrees, total internal reflection (TIR) facets may be used as the ray deflection mechanism. TIR elements require a higher aspect ratio of structure height to base width, and are therefore more challenging to manufacture.

Figure 6:
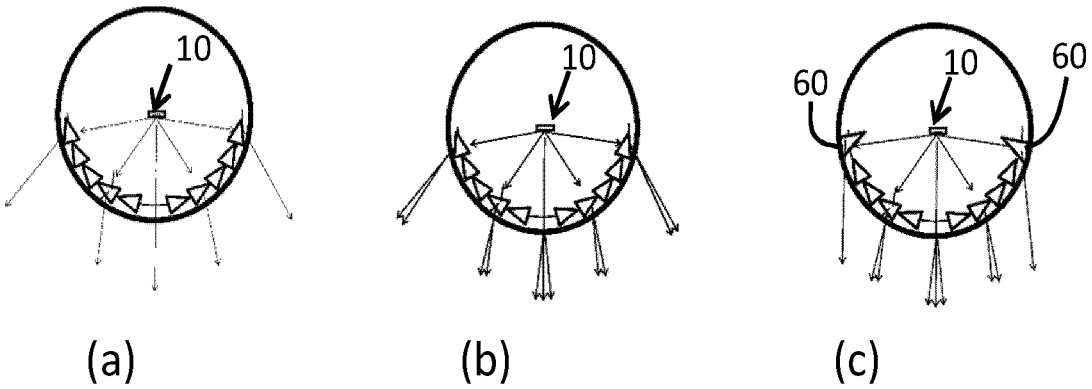
FIG. 6 shows possible combinations of facet designs.

FIG. 6 shows possible combinations of facet designs. FIG. 6(*a*) shows refractive facets for beam collimation, and FIG. 6(*b*) shows refractive facets with dithered facets. FIG. 6(*c*) shows beam collimation using TIR facets 60 at the outermost edges.

The overall beam shaping function may be used to create different beam shapes.

Figure 7:
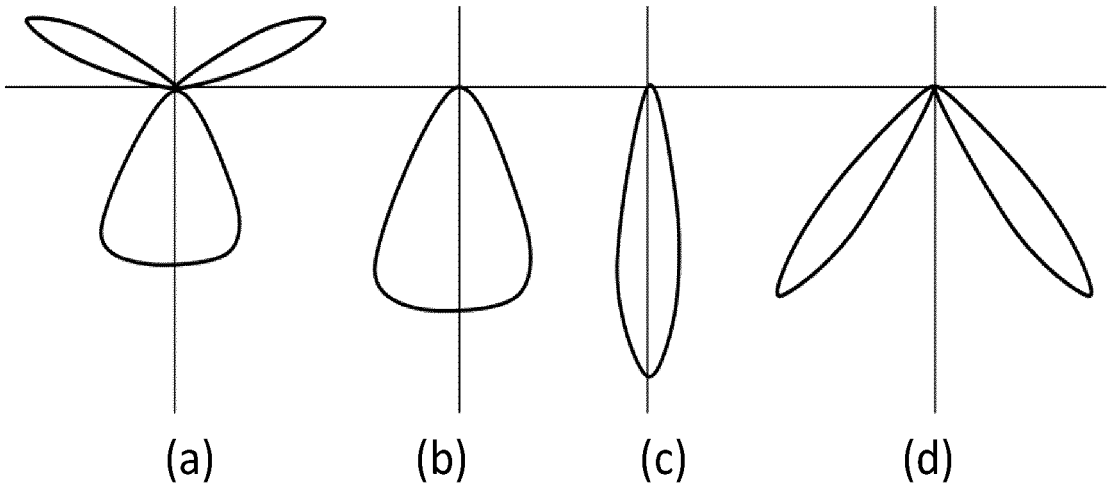
FIG. 7 shows various possible beam shapes, in cross sectional shape perpendicular to the length axis.

FIG. 7 shows various possible beam shapes, in cross sectional shape perpendicular to the length axis. FIG. 7(*a*) shows an office beam with indirect ceiling lighting, FIG. 7(*b*) shows an office beam with no ceiling lighting, FIG. 7(*c*) shows a narrow beam and FIG. 7(*d*) show a bat wing beam shape.

FIG. 8 shows how the profile of FIG. 7(*a*) can be generated using only a single line of LEDs and a single micro-faceted foil. The foil redistributes the light of a single LED line over an angular range exceeding 180 degrees.

Figure 9:
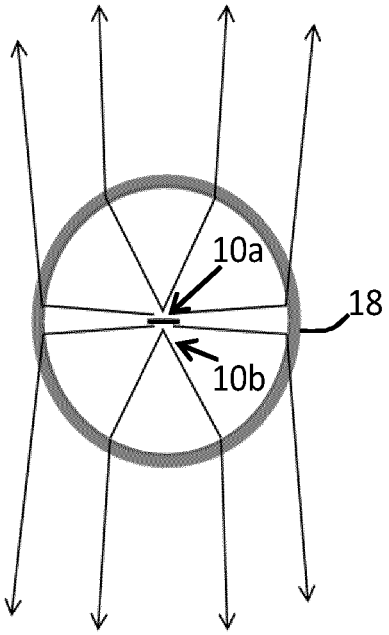
FIG. 9 shows a tubular light with two LED lines pointing in different directions to provide all around illumination.

As shown in FIG. 9, instead of a single LED line, the tubular housing can also contain multiple (2 or more) LED lines 10*a*, 10*b* pointing in different directions. For example, one line of LEDs may be arranged to be pointing up and another may be arranged to be pointing down to illuminate the entire surface of the tubular housing.

Each LED line may illuminate a different part of the foil. Note that this can be implemented with a single foil, consisting of different optical parts.

Figure 10:
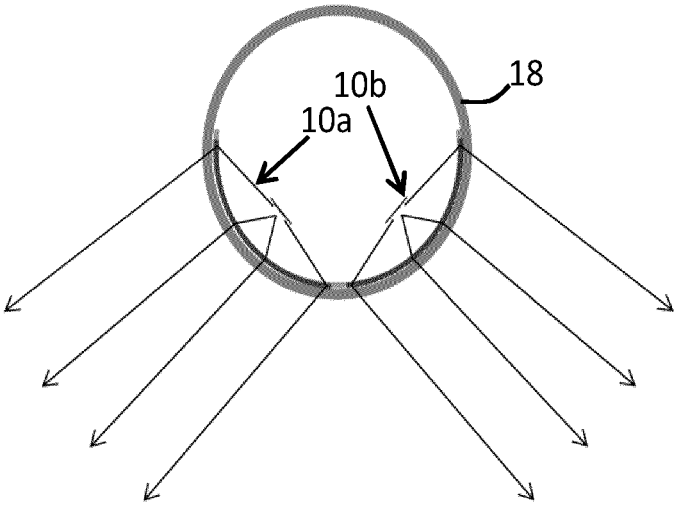
FIG. 10 shows the use of two lines of LEDs, both pointing generally downwardly, to create a bat wing profile

FIG. 10 shows the use of two lines 10*a*, 10*b* of LEDs, both pointing generally downwardly, for example to create the bat wing profile of FIG. 7(*d*).

The invention can be applied to all tubular light retrofit solutions. It enables use in applications that currently use simple tubular light battens without external luminaire components.

The material used for the beam shaping arrangement is typically a plastic such as PMMA or polycarbonate, and the refractive index is for example in the range 1.3 to 1.6.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A tubular light, comprising:

an elongate light source having a length axis and a light output optical axis perpendicular to the length axis;

a tubular housing around the light source; and an optical beam shaping arrangement within the housing around an inner surface of at least an angular portion of the tubular housing for beam shaping of the light output from the elongate light source in a plane perpendicular to the length axis, wherein the optical beam shaping arrangement has an effective focal distance, in the plane perpendicular to the length axis, which varies in dependence on the angular position around the optical beam shaping arrangement, such that the effective focal distance is longer for light in the light output optical axis direction than for light output laterally to the sides of the light output optical axis, and wherein the optical beam shaping arrangement further provides a beam in a general direction of the light output optical axis with a narrower beam width than the beam width of the elongate light source, combined with a beam in an opposite general direction.

2. The tubular light as claimed in claim 1, wherein the elongate light source comprises at least one row of light emitting diodes LEDs.

3. The tubular light as claimed in claim 2, wherein each LED comprises an optical beam shaping element directly over the LED.

4. The tubular light as claimed in claim 2, wherein the LEDs are provided over a carrier, and the light output optical axis is perpendicular to a plane of the carrier.

5. The tubular light as claimed in claim 1, wherein an effective focal position of the optical beam shaping coincides with the position of the elongate light source for the portions of the beam shaping arrangement most laterally offset from the light output optical axis.

6. The tubular light as claimed in claim 1, wherein the optical beam shaping arrangement comprises an array of elongate light redirecting facets extending in the length axis direction, wherein facets at different angular positions around the optical beam shaping arrangement have different facet angle with respect to an incident light from the light source.

7. The tubular light as claimed in claim 6, wherein some of or all of the facets comprise refracting surfaces.

8. The tubular light as claimed in claim 6, wherein some or all of the facets comprise total internal reflection surfaces.

9. The tubular light as claimed in claim 6, wherein the facets are arranged with a pitch, in the plane perpendicular to the length axis, of between 20 μm and 500 μm and/or a radial height of between 30 μm and 100 μm.

10. The tubular light as claimed in claim 1, wherein the optical beam shaping arrangement provides a collimation function, with a lesser degree of collimation for light in the light output optical axis direction than for light output laterally to the sides of the light output optical axis.

11. The tubular light as claimed in claim 1, comprising two elongate light sources each having a length axis and a light output optical axis, wherein the optical beam shaping arrangement provides a bat wing beam profile.

12. The tubular light as claimed in claim 1 wherein an arcuate length of the optical beam shaping arrangement, in the plane perpendicular to the length axis, is greater or equal to $\pi/2$ times a diameter of the tubular housing.

13. The tubular light as claimed in claim 1 comprising a tubular LED lamp designed for use without an external optical beam shaping housing.

* * * * *